United States Patent [19]

Ohki et al.

[11] 3,958,546

[45] May 25, 1976

[54] IGNITION CIRCUIT FOR THE INTERNAL COMBUSTION ENGINE AND PREMATURE IGNITION PREVENTION METHOD IN THE IGNITION DEVICE

[75] Inventors: Yoshinori Ohki, Tokyo; Yoshio Kato, Ichikawa, both of Japan

[73] Assignee: Iida Denki Kogyo K.K., Tokyo, Japan

[22] Filed: Dec. 27, 1973

[21] Appl. No.: 428,833

[30] Foreign Application Priority Data

| | | |
|---|---|---|
| Dec. 30, 1972 | Japan | 47-627 |
| Jan. 17, 1973 | Japan | 48-7513 |
| May 2, 1973 | Japan | 48-50080 |
| May 17, 1973 | Japan | 48-58297 |
| May 26, 1973 | Japan | 48-61707 |
| Nov. 29, 1973 | Japan | 48-134520 |
| Nov. 29, 1973 | Japan | 48-134521 |
| Nov. 29, 1973 | Japan | 48-137901 |
| Nov. 29, 1973 | Japan | 48-137902 |
| Nov. 29, 1973 | Japan | 48-137903 |

[52] U.S. Cl. ..... 123/148 E; 123/149 A; 123/149 R; 315/209 T; 315/209 SC; 322/91

[51] Int. Cl.[2] ..... F02P 1/00; F02P 5/04

[58] Field of Search ..... 123/148 E, 149 D, 149 B; 322/91; 315/209 T

[56] References Cited

UNITED STATES PATENTS

| | | | |
|---|---|---|---|
| 3,476,097 | 11/1969 | Rushton | 123/148 E |
| 3,484,677 | 12/1969 | Piteo | 322/91 |
| 3,599,618 | 8/1971 | Schuette | 123/148 E |
| 3,620,200 | 11/1971 | Stephens | 123/148 E |
| 3,675,635 | 7/1972 | Graser | 123/148 E |

*Primary Examiner*—Charles J. Myhre
*Assistant Examiner*—Ronald B. Cox
*Attorney, Agent, or Firm*—Fidelman, Wolffe & Waldron

[57] ABSTRACT

This invention relates to a method for preventing premature ignition in an ignition device for the internal combustion engine including a non-contact type ignition circuit for the internal combustion engine, particularly an ignition circuit for the internal combustion engine in which an inductive current in the form of an AC waveform induced in a primary winding of an ignition coil is controlled in its conduction and cut-off by means of a transistor circuit, various auxiliary circuits to be disposed for a desired performance in accordance with the purpose of use and the rate of this circuit, and an ignition circuit for the internal combustion engine in accordance with the present invention, and more particularly to a method for preventing premature ignition in an ignition device for the internal combustion engine comprising a transistor circuit for controlling in conduction and cut-off of a primary short-circuit current in the whole circuit and a trigger circuit for controlling the trigger in said transistor circuit, in which auxiliary circuits are added to said trigger circuit or said transistor circuit in accordance with the purpose of use and requirements of the circuit to attain a desired performance, and disadvantages inherent in the inductive discharge type ignition circuit for the internal combustion engine in the art of the present invention are eliminated.

5 Claims, 21 Drawing Figures

Fig. 6
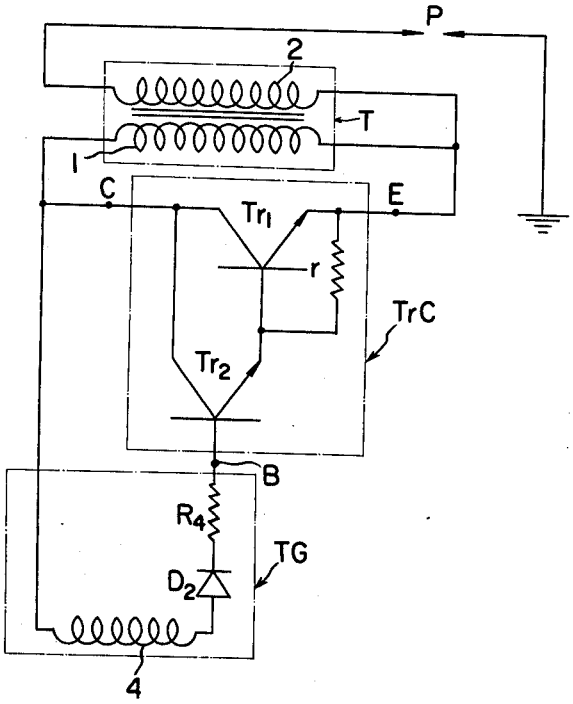
Fig. 8
Fig. 7A
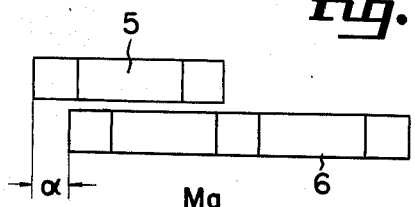
Fig. 7B
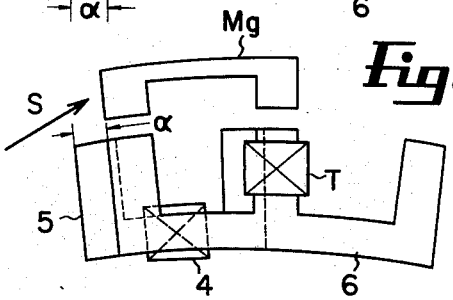
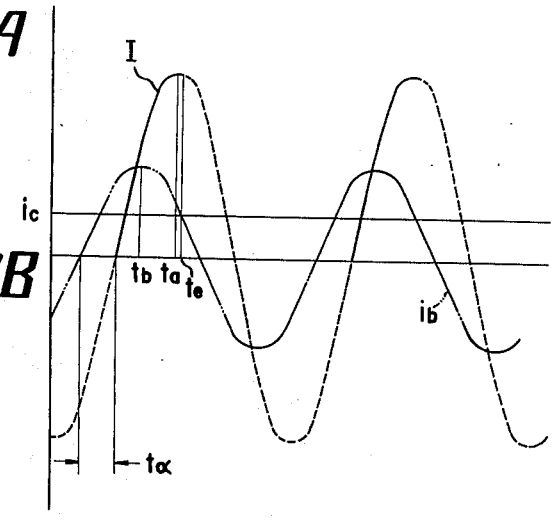

IGNITION CIRCUIT FOR THE INTERNAL COMBUSTION ENGINE AND PREMATURE IGNITION PREVENTION METHOD IN THE IGNITION DEVICE

This invention relates to an ignition circuit to be used for an ignition device in an internal combustion engine, and more particularly to an ignition circuit for the internal combustion engine of non-contact inductive discharge type principally incorporating transistors. This ignition circuit is an auxiliary circuit which prevents premature ignition by protecting transistors principally incorporated in the ignition circuit, by varying ignition timing according to the kind of machine, and by controlling a current in counter direction. Further, the invention provides a method for preventing premature ignition by completely eliminating drawbacks essentially encountered with the inductive type ignition device, that is to say, unrequired magnetic action such as magnetic action produced from permanent magnet embedded in a flywheel relative to the secondary winding of an ignition coil connected to the plug.

Some of the oldest type ignition circuit for the internal combustion engine employs a breaker intermittently operated by means of a cam through the rotation of a crank shaft on the engine. This ignition circuit using the breaker has a number of problems and disadvantages such that its mounting position is extremely limited; it has a short service life since contacts of the breaker wear quickly; it has a complicated circuit construction in consideration of protection of the contacts; the device has a limitation in reducing its volume; and it requires many processes and labors at the time of assembly. For such disadvantages noted above, a device has recently been proposed, in which an electric power induced by a power supply coil is stored in a condenser, and the power thus stored in the condenser is discharged into the primary winding of the ignition coil by means of a semi-conductor switch element.

The construction of the ignition circuit just mentioned has an advantage such that the power supply coil, the ignition coil, and a trigger coil for the semi-conductor switch element are merely limited in their mounting positions, but other parts are not at all limited in their mounting positions, and that the whole device may be made smaller in size to some extent and has no wear of contacts so that the life of the circuit may extensively be prolonged.

However, in the conventional ignition circuit using a semi-conductor switch element, a power induced by an electromagnetic induction action of the permanent magnet embedded in the flywheel is an AC waveform, the induced power is great in value, a circuit tends to be disposed in place where temperature is high, and the semi-conductor switch element is very difficult to resist to heat. For reasons noted above, the ignition circuit using a semi-conductor switch element has been limited to a capacity discharge type ignition circuit in which the power inducted in the power supply coil is once stored in the condenser, and the power thus stored in the condenser is then discharged into the primary winding of the ignition coil through the semi-conductor switch element. In the conventional ignition circuit for the internal combustion engine of capacity discharge type using a semiconductor switch element, as above-described, a power supply coil and a condenser have to be newly installed, thus increasing iron material and copper material used for the ignition circuit and being difficult to have the device small-sized, and further weight of the device further increases. Further, the problem of wear of contacts has been solved, but troubles such as breakage of winding caused by surge voltage in the power supply coil often occur, thus being impossible to achieve a semi-permanent service life. Since it is required to provide with a condenser which can store power enough to generate a spark discharge in the plug connected to the secondary winding of the ignition coil, a costly condenser must be provided, and further condenser itself is less in its heat resistance so that deterioration thereof is quick, and in addition the capacity discharge type is used so that spark discharge time in plug is extremely short, which results in insufficient combustion of fuel, and troubles such as occurrance of accidental fire could not sometimes be avoided.

This invention overcomes various limitations noted above with respect to prior art devices. The primary object of this invention is to provide an inductive type ignition circuit for an internal combustion engine, which has previously been donsidered to be unsuitable to utilize a semi-conductor switch element, by providing a transistor circuit, which has not at all been used in an ignition circuit due to its low heat resistance and inverse voltage resistance, as a switch element which controls conduction and cut-off of a primary short-circuit current. The second object is to make delicate adjustment of positive ignition operation and ignition timing by accomplishing trigger in the transistor circuit by means of a silicon controlled rectifier. The third object is to completely prevent the transistor from producing heat to provide a semi-permanent life of a circuit by impeding flow of current in counter direction into the transistor circuit. The fourth object is to prevent the transistor from producing heat, and to prevent premature ignition and delay of ignition timing by not completely impeding flow of current in counter direction into the transistor circuit but by flowing a current in counter direction within the practically allowable range. The fifth object is to automatically place ignition timing in angle of lead or angle of lag as rotational speed of the internal combustion engine reaches a given value in a circuit having a trigger circuit which principally incorporates a silicon controlled rectifier. The fifth object is to automatically place ignition timing in angle of lag at the time when rotational speed of the internal combustion engine reaches a given value by utilization of entirely different technical means, that is, the phenomenon in which when an inverse current is passed into the primary winding, voltage in a proper direction in the secondary winding is built delayed. The seventh object is to provide a method for preventing premature ignition, in which the drawback as premature ignition encountered with respect to the inductive type ignition circuit for the internal combustion engine is eliminated in such a manner that an electromagnetic induction action from the primary winding relative to the secondary winding of the ignition coil is taken place only when a primary short-circuit current is passed into the primary winding and the permanent magnet is magnetically cut-off from the secondary winding.

Other many objects and advantages of the invention will become apparent from the following description of embodiments with reference to the accompanying drawings, in which.

Figure 1:
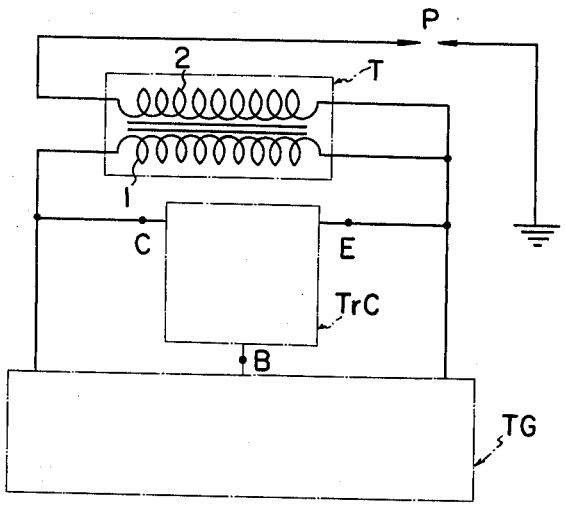
FIG. 1 is a basic circuit representation in accordance with the present invention.
Figure 3:
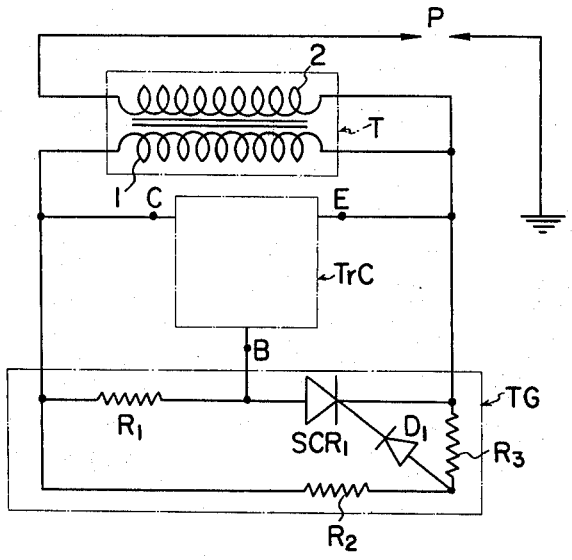
Figure 4:
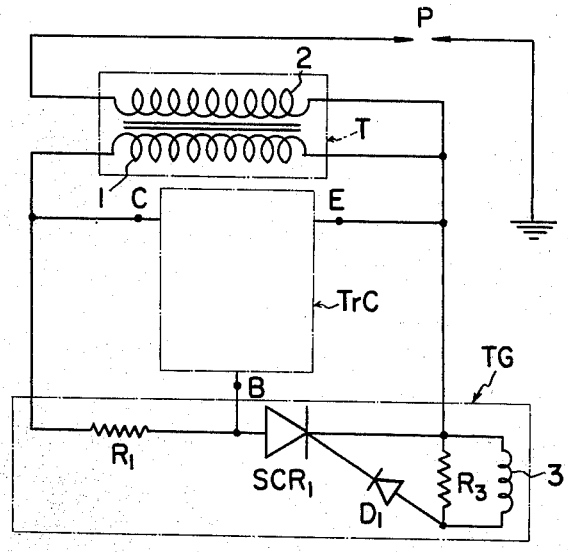
Figure 5:
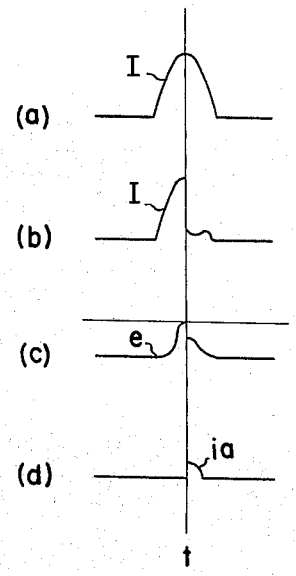
Figure 9:
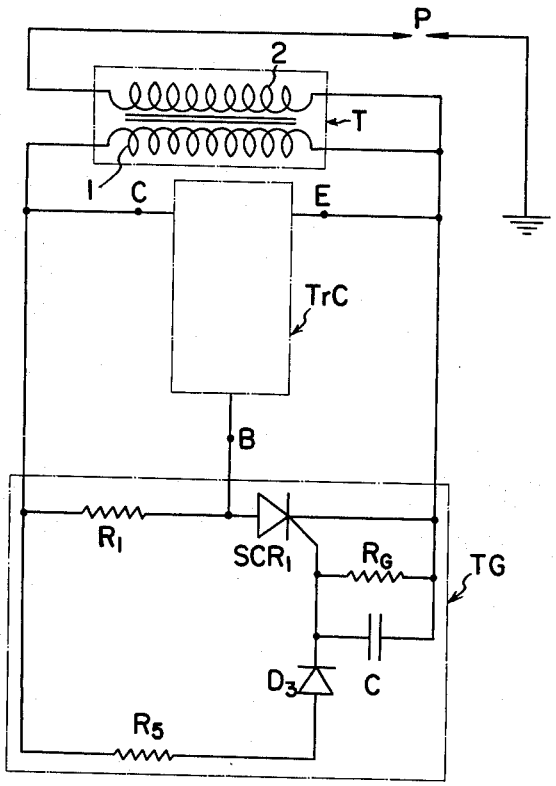
Figure 10:
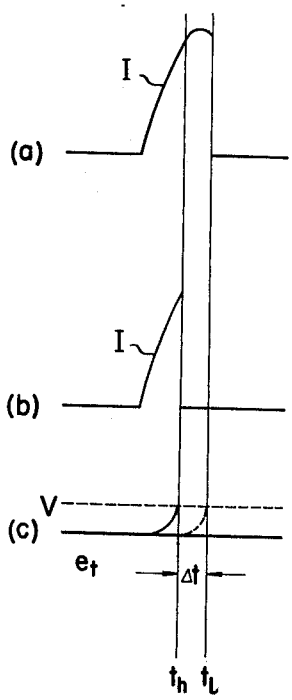

FIGS. 3–10 illustrate embodiments of trigger circuits different from the basic circuit shown in FIG. 1, and waveforms of a primary short-circuit current; in which FIGS. 3 and 4 are trigger circuits principally incorporating silicon controlled rectifier, FIG. 3 being formed to set trigger timing of the silicon controlled rectifier in accordance with variation in value of the primary short-circuit current, while FIG. 4 being formed to set trigger timing of the silicon control rectifying element according to arrangement of a trigger coil with respect to the ignition coil irrespective of variation in value of the primary short-circuit current, FIG. 5 illustrates an operating diagram in the embodiments as shown in FIGS. 3 and 4, FIG. 6 is a trigger circuit constructed to suit to high speed operation, the figure being simplified, FIG. 7 illustrates an arrangement of the trigger coil with respect to the ignition coil, FIG. 8 illustrates an operating diagram, FIG. 9 illustrates an embodiment of a trigger circuit formed to automatically adjust ignition timing in accordance with operation speed of the internal combustion engine, principally incorporating silicon controlled rectifier similar to those embodiments shown in FIGS. 3 and 4, FIG. 10 illustrates its operating diagram.

Figure 11:
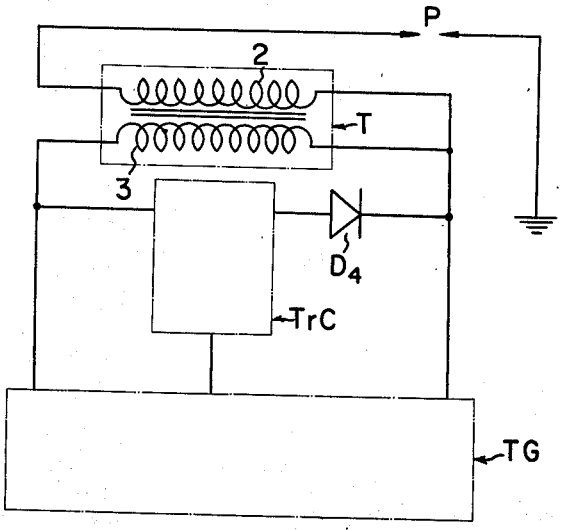
Figure 12:
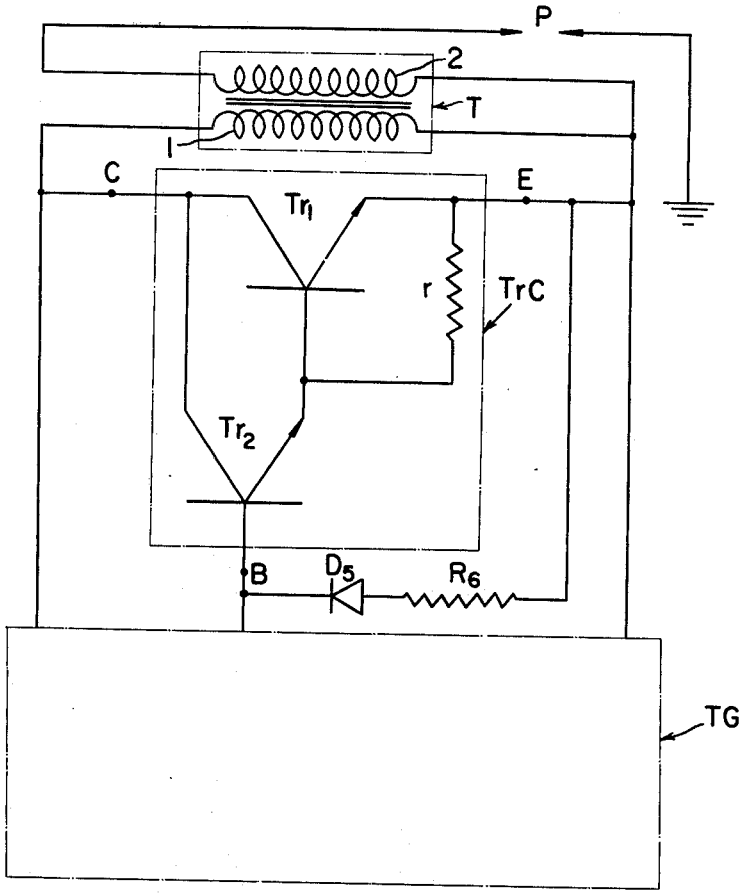
Figure 13:
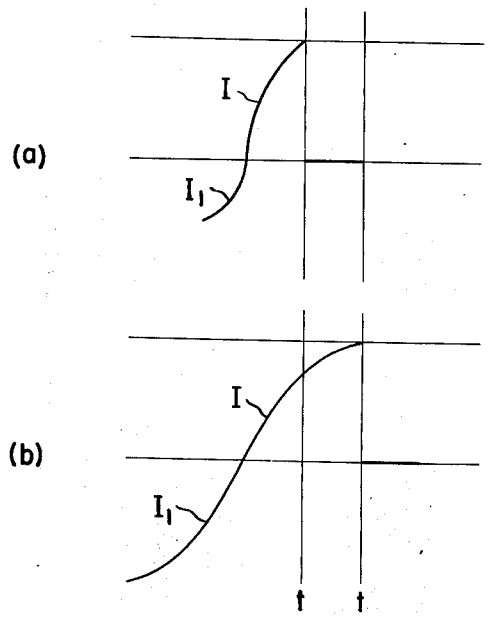
Figure 14:
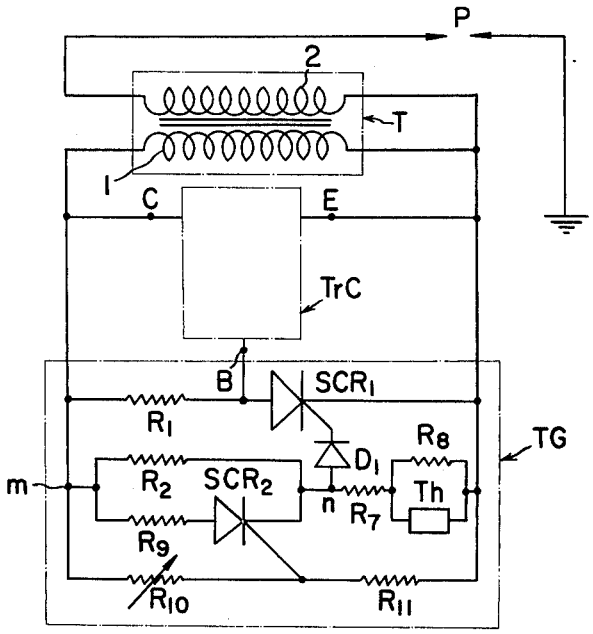
Figure 15:
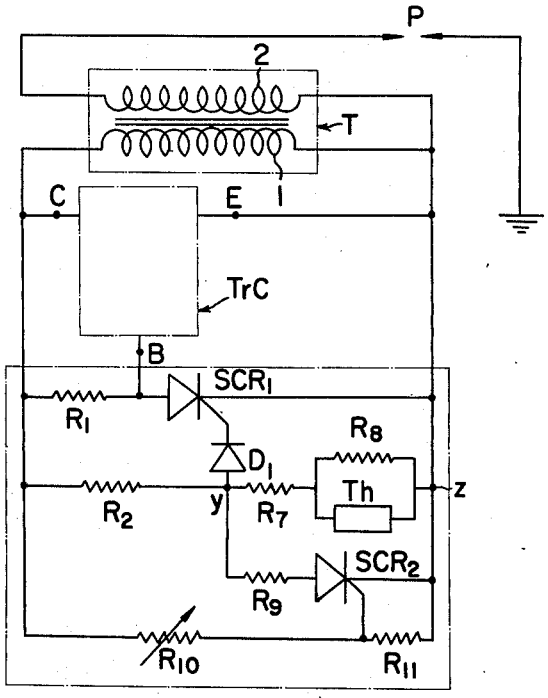
Figure 16:
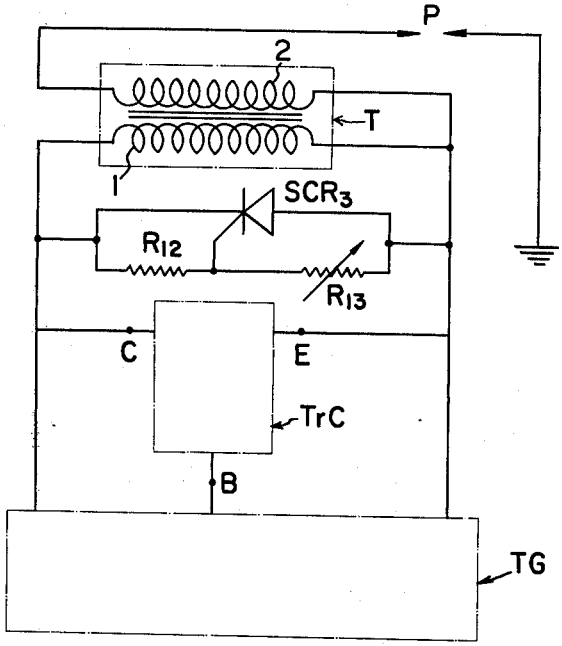
Figure 17:
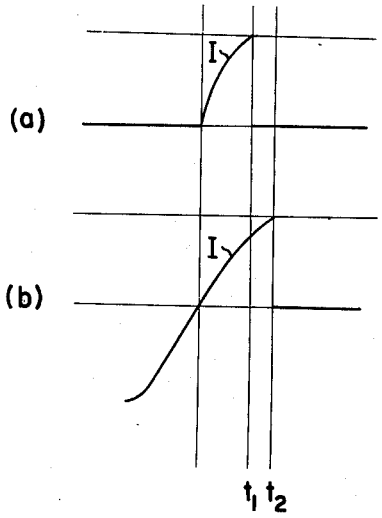
Figure 18A:
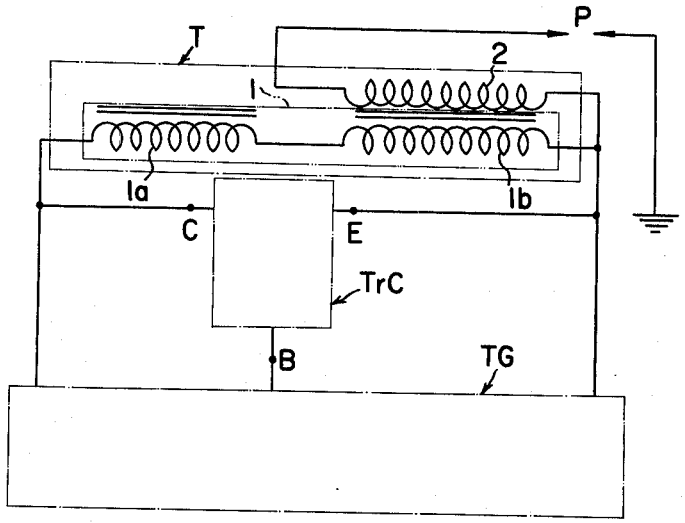
Figure 18B:
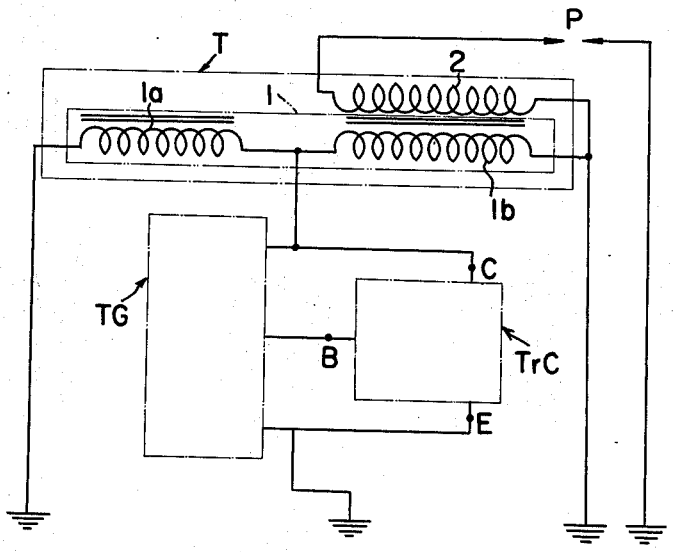

FIG. 11 is a protective circuit of the transistor circuit particularly taken from the basic circuit shown in FIG. 1;

FIG. 12 is a circuit for preventing heat generation and premature ignition to protect the transistor circuit, similarly to FIG. 11, and in the form of a transistor circuit formed to prevent premature ignition;

FIG. 13 illustrates an operating diagram thereof;

FIG. 14 is a circuit for automatically placing ignition timing in angle of lead, in which ignition timing is placed in angle of lead for a given amount as speed of internal combustion engine reaches a predetermined value;

FIG. 15 is a circuit for automatically placing ignition timing in angle of lag, in which ignition timing is placed in angle of lag as speed of internal combustion engine reaches a predetermined value;

FIG. 16 is a circuit for automatically placing ignition timing in angle of lag, in which ignition timing is placed in angle of lag for a given amount by the operating principle different from the circuit shown in FIG. 15 as speed of internal combustion engine reaches a predetermined value;

FIG. 17 is an operating diagram of the circuit shown in FIG. 16;

FIG. 18 is a view showing a method for preventing premature ignition in the ignition device for the internal combustion engine employing the basic circuit shown in FIG. 1, and FIGS. 18A and 18B illustrating embodiments showing a modified connection of the basic circuit shown in FIG. 1 with respect to the ignition coil embodying the aforesaid method.

Figure 2A:
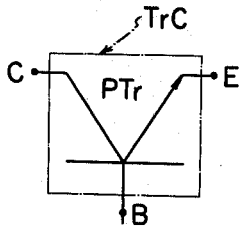
FIGS. 2 and 3 are modified circuits of the basic circuit shown in FIG. 1, which are used as a transistor circuit.

Referring to FIG. 1, which illustrates a basic circuit of an ignition circuit for the internal combustion engine in accordance with the present invention, a transistor circuit TrC is connected to primary winding 1 in ignition coil T, and a trigger circuit TG is connected to base B in the transistor circuit TrC. The transistor circuit TrC has two types, according to one of which only one power transistor PTr is employed as shown in FIG. 2A, and according to the other of which a Darlington circuit consisting of two transistors $Tr_1$ and $Tr_2$ and a stabilized resistance ($r$) is employed. Even if one power transistor PTr is used in the transistor circuit TrC or the Darlington circuit is used therein, a fundamental operating mode as a transistor circuit TrC, that is, an operating mode which controls conduction and cut-off of a primary short-circuit current I, is not at all different therebetween. However, in view of facts such as low cost, great current gain, easy performance of connections in various auxiliary circuits, etc., the Darlington circuit may be advantageously used, while in view of simplifying the construction of transistor circuit TrC, the power transistor PTr may be advantageously used.

In the connection of the transistor circuit TrC to the primary winding 1, transistor circuit TrC is inserted between both terminals of the primary winding and connected by collector C and emitter E in such a manner that when transistor circuit TrC is in conduction, the primary short-circuit current I may be passed into the primary winding. A trigger circuit TG suitably arranged is connected to base B in the transistor circuit TrC, conduction and cut-off of the primary short-circuit current I in the transistor circuit TrC being controlled by the trigger circuit TG.

The circuit of the invention will now be described in order of construction of the trigger circuit TG.

In the trigger circuit TG used in the circuit in accordance with the present invention, conduction and cut-off of primary short-circuit current I is controlled by the transistor circuit TrC so that the circuit is constructed by principally incorporating a silicon controlled rectifier (hereinafter merely referred to as SCR) with exception of the case in which object of use is limited as in the embodiment shown in FIG. 6. However, this is because of that when SCR is once triggerred, circuit is not brought in off condition unless an inverse current is applied between cathode and anode thereof or an inverse potential is formed between gate and cathode, whereby transistor circuit PrC once cut-off by conduction of SCR is never returned to a conductive condition again during one cycle of the primary short-circuit current formed in AC waveform, thus satisfactorily preventing troubles such as reignition from being occurred.

In the embodiments as shown in FIGS. 3 and 4, at the time ($t$) when primary short-circuit current reaches a predetermined value, $SCR_1$ is triggered to bring the potential between base B and emitter E zero (0) in value, placing the transistor circuit TrC in off condition, whereby the primary short-circuit current I is rapidly cut-off to induce a high voltage in the secondary winding 2 of the ignition coil T, thereby producing a spark discharge in plug P. In the embodiment shown in FIG. 3, triggerring $SCR_1$ is made by variation in value of primary short-circuit current I, while in the embodiment as shown in FIG. 4, triggerring $SCR_1$ is made by positional arrangement of a trigger coil 3 with respect to the ignition coil, irrespective of variation in primary short-circuit current I.

That is, as shown in FIG. 3, a series circuit comprising a bias resistor $R_1$ in the transistor circuit TrC and $SCR_1$ connected to the terminal of the primary winding 1 and having its anode connected to resistor $R_1$ and its cathode connected to emitter E in the transistor circuit TrC so as to flow a current in proper direction (branch current of the primary short-circuit current I) is connected between terminals of the primary winding 1 in parallel with the transistor circuit TrC; base B in the transistor circuit TrC is connected at connection between resistor $R_1$ and $SCR_1$, that is, connected to the anode of $SCR_1$ and a series circuit comprising resistor $R_1$ and $SCR_1$ is connected in parallel with a bias circuit having a series connection of resistor $R_2$ and bias resistor $R_3$ for $SCR_1$; and gate of $SCR_1$ is connected to connection in said bias circuit, that is, connection between resistors $R_2$ and $R_3$ through an inverse current blocking diode $D_1$.

With the ignition circuit as shown in FIG. 3 constructed as described above, when a voltage in proper direction is induced in the primary winding, a current in proper direction (though small in value) flows into base B in the transistor circuit TrC through resistor $R_1$ to cause voltage drop in resistor $R_1$ so that a bias voltage is applied between collector C and base B in the transistor circuit TrC, placing the transistor circuit TrC in conductive condition. Therefore, primary short-circuit current I is to be flown, from the beginning of its building up, through collector C and emitter E in the transistor circuit TrC (See FIG. 5).

When the value of the primary short-circuit current I is increased and reaches a predetermined value (this predetermined value of the primary short-circuit current I which can induce in secondary winding 2 a voltage enough to produce spark discharge in plug P by reaction of rapid cut-off of the primary short-circuit current I), $SCR_1$ is triggerred because of voltage drop in resistors $R_2$ and $R_3$ caused by flow of primary short-circuit current I through the transistor circuit TrC and by current flown into the bias circuit. This triggerring of $SCR_1$ brings the potential between base B and emitter E in the transistor circuit TrC to zero, thus placing the transistor circuit TrC in cut-off condition to rapidly cut-off the primary short-circuit current I. This rapid cut-off of the primary short-circuit current I causes magnetic reaction to be produced in the ignition coil T, which results in inducing a high voltage in the secondary winding 2 to produce spark discharge in plug P.

As is apparent from the mode of operation as described above, ignition time ($t$) of the ignition circuit is determined by a combined resistance of resistors $R_2$ and $R_3$, rate of resistance value between resistors $R_2$ and $R_3$, and a resistance value of resistor $R_3$. The ignition time ($t$) once set remains constant unless the rate of resistance value between resistors $R_2$ and $R_3$ is varied. On the other hand, in the trigger circuit TG as shown in FIG. 4, a series circuit comprising a bias resistor $R_1$ in the transistor circuit TrC and $SCR_1$ connected to the terminal of the primary winding 1 and having its anode connected to resistor $R_1$ and its cathode connected to emitter E in the transistor circuit TrC so as flow a current in proper direction is connected between terminals of the primary winding 1 in parallel with the transistor circuit TrC; base B in the transistor circuit TrC is connected at connection between resistor $R_1$ and $SCR_1$, that is, connected to the anode of $SCR_1$, and gate is connected to a parallel circuit consisting of bias resistor $R_3$ and trigger coil 3 through the cathode of $SCR_1$ and the inverse current blocking diode $D_1$. The trigger coil 3 is disposed in position delayed at a given electrical angle to the ignition coil T, with respect to the permanent magnet Mg (see FIG. 7 B) embedded in the flywheel and adapted to be rotated.

In the embodidment shown in FIG. 4 constructed as described above, trigger controlling of transistor circuit TrC by way of the trigger circuit TG is entirely same as that of the embodiment shown in FIG. 3, but trigger time ($t$) of $SCR_1$ may be set in a quite different manner. That is, the trigger time ($t$) in the embodiment shown in FIG. 4 may be determined merely by positional arrangement of the trigger coil 3 relative to the ignition coil T, irrespective of variation in primary short-circuit current I. This positional arrangement of the trigger coil 3 relative to the ignition coil T is such that at the time when a high voltage enough to produce spark discharge in plug P when primary short-circuit current I is rapidly cut-off, a current enough to trigger $SCR_1$ by voltage drop in resistor $R_3$ is induced in the trigger coil 3.

That is, in the embodiment shown in FIG. 3 and the embodiment shown in FIG. 4, spark discharge is produced in plug P by rapidly cutting off the primary short-circuit current I, waveform of which should be as shown in ($a$) in FIG. 5, at time ($t$) in the form of a waveform as shown in ($b$) in FIG. 5 by triggerring $SCR_1$ at time ($t$). There is shown in ($c$) in FIG. 5 a trigger voltage waveform (voltage drop waveform in resistor $R_3$) applied between the gate and the cathode in $SCR_1$, and $SCR_1$ is brought in conductive condition by the trigger voltage ($e$) of $SCR_1$. Further, ($d$) in FIG. 5 shows a waveform of current ($id$) flowing through $SCR_1$. In FIG. 7B, which shows a waveform of primary short-circuit current I, a small amount of current flows after time ($t$) cut-off, and this current is a branch current flowing through $SCR_1$.

Thus, the embodiment shown in FIG. 3 is different in method of triggering $SCR_1$ from the embodiment shown in FIG. 4. However, whichever of these methods may be used in accordance with the rate, operating conditions, or the like of the internal combustion engine in which the circuit of the present invention is employed. In the case of the embodiment shown in FIG. 3, the circuit is simple in construction and the mounting place has no limitation and the manufacturing cost is low, while in the case of the embodiment shown in FIG. 4, it has such advantages that the ignition time ($t$) may be set irrespective of the value in the primary short-circuit current I and further the range of setting the ignition time ($t$) is extensive as compared with the case in the embodiment shown in FIG. 3.

The embodiment of the trigger circuit TG shown in FIG. 6 provides a trigger circuit TG which is simple in construction and which can be manufactured inexpensively, and further which is designed to most suitably be mounted on the internal combustion engine adapted to be driven at high speed. In FIG. 6, a trigger circuit TG is provided in which a series connection circuit consisting of a trigger coil 4, an inverse blocking diode $D_2$ which only allows to pass a current in proper direction from said trigger coil 4 to the base B in the transistor circuit TrC, and a resistor $R_4$ as a base stabilized resistor, is connected between the terminal of the primary winding 1 having collector C in the transistor circuit TrC and the base B in the transistor circuit TrC. The trigger coil 4 is wound on a core 5 arranged to be positioned frontwardly by a given distance ($\alpha$) from a core 6 on which ignition coil T is wound, relative to the rotational direction S of permanent magnet MG (See FIG. 7B) embedded in the flywheel and adapted to be rotated in a given direction S. Accordingly, voltage induced in the trigger coil 4 by the permanent magnet Mg is created (see FIG. 8) at the quicker time, corresponding to the distance ($\alpha$) than the voltage induced in the ignition coil T by the permanent magnet Mg. Diode $D_2$ connected in series with the trigger coil 4 is block, since current induced in the trigger coil is in AC waveform, a current, which tends to flow toward the trigger coil 4 from the base B in the transistor circuit TrC, among said AC current.

With the embodiment shown in FIG. 6 constructed as above described, when the permanent magnet Mg is rotated in the direction as indicated at S (see FIG. 7B) relative to the cores 5 and 6 by actuation of the internal combustion engine, voltage is first induced in the trigger coil 4 wound on the core 5 by action of magnetic flux from the permanent magnet Mg, and by the voltage thus induced, base current (*ib*) is flown from the trigger coil 4 to the base B in the transistor circuit, placing the transistor circuit TrC in conductive condition.

After the lapse of the time (t$\alpha$) corresponding to the distance ($\alpha$) followed by initiation of flow of base current (*ib*) (said time (*t*$\alpha$) varies in such a manner that it becomes shorter when rotational speed of the permanent magnet Mg is increased by variation of operation speed of the internal combustion engine, that is, variation of rotational peripheral speed of the permanent magnet Mg, while it becomes longer when the rotational peripheral speed of the permanent magnet Mg is decreased), voltage is induced in the ignition coil T wound on the core 6 opposite the permanent magnet Mg. At the time when the voltage was induced in the ignition coil T, the transistor circuit TrC has been placed in conductive condition by the voltage produced in the trigger coil 4 so that the transistor circuit TrC will be placed in conductive condition at the same time when the voltage is inducted in the ignition coil T, and the primary short-circuit current I is flown into the primary winding 1 through the collector C and emitter E in the transistor circuit TrC.

The period of the primary short-circuit current I is the same as that of the base current (*ib*), but there is a phase difference by time (*td*) (see FIG. 8) between the primary shortcircuit current I and the base current (*ib*). Therefore, the primary short-circuit current I becomes maximum after time (td) from time (*tb*) where the base current (*ib*) is maximum. If constant of the trigger coil 4 is set so that the base current (*ib*) reaches minimum (*ie*) where the transistor circuit TrC may be maintained in conductive condition at substantially same time as time (*ta*) where the primary short-circuit I is maximum, the transistor circuit TrC is placed in non-conductive condition at the time (*te*) where the value of the base current (*ib*) is lower than the minimum (*ie*) to cut-off the primary short-circuit current I, producing spark discharge in plug P. That is, the time (te) serves as the ignition time (*t*).

Thus, the primary short-circuit current I is cut-off when it reaches maximum and at the time (*te*) where the base current (*ib*) reaches minimum (*ie*) at which the transistor circuit TrC may be maintained in conductive condition. However, the time (*te*) is set by a biased distance (*d*) along the rotational direction of the permanent magnet Mg of cores 5 and 6 and by a rotational peripheral speed of the permanent magnet Mg, and the phase difference between the primary short-circuit current I and the base current (*ib*) produced by the distance (*d*), that is, time (*t*$\alpha$) becomes shorter as the rotational peripheral speed of the permanent magnet Mg increases so that setting of time (*te*), that is, the distance (*d*) between the cores 5 and 6 is required to be set so as to suit to either high speed time or low speed time of the internal combustion engine. The relationship between the rotational speed of the permanent magnet Mg and the time (*t*$\alpha$) with the distance (*d*) set constant is represented by a parabola, where the rotational speed of the permanent magnet is taken by axis of ordinate and the time (*t* $\alpha$) is taken by axis of abscissa, and variation of time (*t*$\alpha$) relative to variation in speed of permanent magnet Mg at the time of high speed of the permanent magnet Mg is much greater in ratio than variation of time (*t*$\alpha$) relative to variation in speed of the permanent magnet Mg at the time of low speed of the permanent magnet Mg, therefore the present invention provides a good operation within the range of high speed operation (in excess of 500 rpm) of the internal combustion engine.

The embodiment of the trigger circuit TG shown in FIG. 9 electrically overcomes the disadvantage encountered with respect to the embodiment shown in FIG. 3, that is, the disadvantage such that when the ignition time (*t*) is once set, the ignition time (*t*) can not be varied in accordance with the rotational speed of the internal combustion engine unless the ratio between the resistors $R_2$ and $R_3$ is varied, and in accordance with the arrangement shown in FIG. 9, a series circuit consisting of resistor $R_1$ and $SCR_1$ is connected between the terminals in the primary winding 1 in parallel with the transistor circuit TrC in the same mode as that shown in FIG. 4; a series circuit consisting of a resistor $R_5$ and an inverse current blocking diode $D_3$ is connected between the terminal opposite the terminal of resistor $R_1$ connected to the anode of $SCR_1$ and the gate of $SCR_1$ in the mode having the diode $D_3$ connected to the gate of $SCR_1$; and a parallel circuit consisting of a voltage controlling resistor $R_G$ and a condenser Cn for controlling angle of lead is connected to the connection between $SCR_1$ and diode $D_3$. As is known, the resistor $R_G$ serves to produce a potential for triggerring $SCR_1$ between the gate and the cathode of $SCR_1$, and the condenser Cn serves electrically to place a triggerring current which flows into the resistor $R_G$ (said current is a branch current of the primary short-circuit current I) in angle of lead in phase with respect to the primary short-circuit current I in accordance with the frequency of the primary short-circuit current I.

With the embodiment shown in FIG. 9 constructed as above described, at the same time when the primary short-circuit current I is flowing, a trigger current flows from the primary winding 1 to resistor $R_5$ and diode $D_3$ and returns to the primary winding 1 through a parallel circuit consisting of resistor $R_G$ and condenser Cn, and a potential corresponding to voltage drop caused by the resistor $R_G$ is produced between the cathode and the gate in $SCR_1$. As the primary short-circuit current I increases, the voltage drop by the resistor $R_G$, that is, a trigger voltage (*et*) increases, and if the value of resistor $R_G$ is set so that the trigger voltage (*et*) reaches a value (V) at which $SCR_1$ may be triggerred at the time (*t*) when the primary short-circuit current I is in a value enough to produce spark discharge in plug P, $SCR_1$ is triggerred at the time (*t*) when the trigger voltage (*et*) reaches the voltage (V), whereby the primary short-circuit current I is rapidly cutoff to produce spark discharge in plug P.

While the embodiment shown in FIG. 9 provides an operation as an ignition circuit, the condenser Cn is connected to the gate of $SCR_1$, so that voltage or trigger voltage appeared between the terminals of the condenser Cn with respect to the gate current or trigger current which flows into said gate, is electrically placed in angle of lead in phase than the trigger current or the primary short-circuit current I by a value determined by a value of resistor $R_5$, capacity of condenser Cn, and frequency of primary short-circuit current I.

The angle of lead in phase of voltage relative to current by condenser tends to increase in proportion to increase in frequency of current, and current or primary short-circuit current induced in the primary winding 1 is determined in proportion to rotational speed of flywheel or operation speed of the internal combustion engine, so that the angle of lead on trigger voltage (*et*) by the condenser Cn becomes great as the operation speed of the internal combustion engine increases.

That is, by properly setting the value of resistor $R_5$ and the capacity of condenser Cn, the time of cutting off the primary short-circuit current I or the ignition time (*t*) may be automatically adjusted in accordance with the operation speed of the internal combustion engine within the desired range of time ($\Delta t$) (see FIG. 10) during the time from a start to high speed operation of the internal combustion engine. Accordingly, if arrangement is made so that time (*te*), at which a triggerring voltage V at the time of starting the internal combustion engine is obtained, is set to be time somewhat delayed than time, at which primary short-circuit current I is maximum, by properly setting the value of resistor $R_5$ and the capacity of condenser Cn, and that time (*th*), at which a trigger voltage (*et*) at the time of high speed operation of the internal combustion engine reaches voltage V, is set to be time quicker than time, at which primary short-circuit current I is maximum (it will be understood that the value of the primary short-circuit current I at time (*te*), (*th*) is set within the value enough to produce spart discharge in plug P when the primary short-circuit current I is rapidly cut-off), the ignition time (*t*) may be automatically adjusted in accordance with the rotational speed of the internal combustion engine, thus always obtaining a good ignition timing within the range of variation in all the rotational speeds of the internal combustion engine.

In accordance with the trigger circuit TG shown in FIG. 9, ignition timing may be adjusted by electrical action of condenser Cn, thus providing a simple and inexpensive in construction as compared with prior art governor mechanisms for adjustment of timing which is extremely complicated and costly, and ignition timing may further be adjusted by mere utilization of electrical characteristics of the condenser Cn as compared with prior art governor mechanism in which ignition timing is adjusted by mechanical operation, thus smoothly accomplishing automatic adjusting operation of ignititon timing, and further the angle of lead of a trigger voltage (*et*) to a trigger current may be freely and extensively determined by varying capacity of the condenser Cn, thus easily and widely providing adjustment of ignition timing, and still further the capacity of condenser Cn may be suitably set to place the angle of lead of the trigger voltage (*et*) greater than increase in rotational speed of the internal combustion engine, thus automatically preventing the internal combustion engine positively and simplify from being overrun.

Figure 2B:
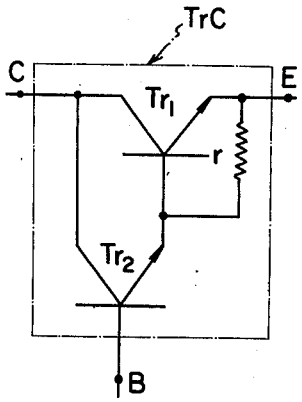

Thus, various trigger circuits TG may be employed to the basic circuit of the invention as shown in FIGS. 1 and 2. This is advantageously classified in such that the embodiment shown in FIG. 3 is applied to the internal combustion engine which is driven at a constant speed, and the embodiment shown in FIG. 4 is applied to the internal combustion engine which is previously provided with a governor mechanism. This is because of that automatic adjustment of timing may readily be accomplished in accordance with speed of the internal combustion engine by utilization of the governor mechanism previously mounted in such a manner that positional arrangement of the trigger coil 3 to the ignition coil T is automatically varied in accordance with the speed of the internal combustion engine. The embodiment shown in FIG. 6 is well suited to the internal combustion engine which is driven at a high speed and at a substantially constant speed, as previously described. The embodiment shown in FIG. 9 is well suited to those internal combustion engines such as internal combustion engine for automobiles, which requires to obtain a good ignition timing in the wide range from a start to a high speed operation.

A circuit shown in FIG. 11 is a protective circuit for the transistor circuit TrC in the basic circuit of the present invention shown in FIG. 2.

In general, since voltage induced in the primary winding 1 is in the form of AC waveform, an inverse voltage substantially equal to a voltage in proper direction is acted between the collector C and the emitter E in the transistor circuit TrC after the primary short-circuit current I has been cut-off, and this action of the inverse voltage causes an inversely leaking current to be flown between the emitter E and the collector C, thus generating heat in the transistor circuit TrC. Further, since the voltage induced in the primary winding includes a large amount of higher harmonic portions, the inversely leaking current flown between the emitter E and the collector C in the transistor circuit accelerratively increases, thus rapidly increasing the amount of generated heat in the transistor circuit TrC.

It is therefore required for an ignition circuit for the internal combustion engine to use transistors of the type which are extremely great in heating value as compared with those transistors as used for other usual electrical circuits, necessitating a large-scaled radiator, and such circuit had to be mounted in place suited for radiation. Further, even if the radiating mechanism having a good efficiency is mounted, this radiating mechanism will not be effectively operated before the transistor circuit TrC is heated, and therefore the heat generation in the transistor circuit TrC can not be held completely, which resulted in shortening the life of the transistor circuit TrC.

Further, since the higher harmonic portions contained in the voltage induced in the primary winding 1 sometimes take a pulse wave high voltage, a transistor having an inverse withstand voltage rated value considerably greater than a basic wave voltage value of the voltage induced in the primary winding 1 must be used in the transistor circuit TrC, which resulted in a great increase of cost for the circuit.

Thus, there have been many problems encountered with respect to the transistor circuit TrC, the problems being such that a large scaled radiating mechanism is required, a mounting location thereof is inevitably limited, and a transistor having an inverse withstand voltage rated value greater than as required.

The protective circuit shown in FIG. 11 overcomes the limitations noted above with respect to the above-described transistor circuit TrC, wherein an inverse current blocking diode $D_4$ is connected to emitter E or collector C in the transistor circuit TrC (in the embodiment shown in FIG. 11, diode $D_4$ is connected to emitter E in the transistor circuit TrC).

Thus, the inverse current blocking diode $D_4$ is connected between the emitter E in the transistor circuit TrC and one terminal of the primary winding 1, so that an inversely leaking current which tends to flow into the transistor circuit TrC may be substantially completely blocked by the diode $D_4$ and the flow of the inversely leaking current into the transistor circuit TrC may be completely blocked. With this, the transistor circuit TrC generates no heat by flow of the inversely leaking current thereinto, thus requiring no particular radiating mechanism, nor necessitating to limit the mounting place for the transistor circuit TrC in attempt of effective prosecution of radiation.

Further, since the diode $D_4$ has its resistance in counter direction considerably greater than the transistor circuit TrC, and even if the induced voltage in the primary winding 1 includes an extremely high pulse wave inverse voltage value, this inverse voltage value is almost acted on the diode $D_4$, to thereby allow the transistor circuit TrC use its value considerably smaller than the case where no diode $D_4$ exists.

Despite the extremely simple construction, the protective circuit for the transistor circuit TrC in the basic circuit shown in FIG. 11 has its better effect as a protective circuit which can prevent the transistor circuit TrC from being heat-generated and can protect the transistor circuit TrC from the inverse voltage. However, since it functions to completely cut-off an inverse current, there is a fear to occur troubles such as premature ignition (i.e. prespark) in which ignition is initiated at the time of inducing an inverse voltage depending upon the capacity of ignition coil T. It is therefore preferred to use the protective circuit shown in FIG. 11 for the ignition circuit to be mounted on a small-sized internal combustion engine. Further, since diode $D_4$ is positioned in a closed circuit into which primary short-circuit I is flown, ampere turn in the ignition coil T will be appeared as power loss by the amount of resistance in the diode $D_4$, giving rise to a low power efficiency.

A method has been proposed to provide with a bypass for flowing an inverse current without via the transistor circuit TrC, as means which overcomes the disadvantages encountered in the protective circuit shown in FIG. 11 and which can prevent the transistor circuit TrC from being heat-generated and can elevate the inverse withstand voltage. However, if an inverse current is flown into such a bypass as described, a proper current in the primary winding 1 or primary short-circuit current I is considerably delayed, due to the great inverse current flown into the primary winding 1, by inductive magnetic action of the inverse current, and the ignition time ($t$) is considerably delayed due to the delay of building-up of the primary short-circuit current I. Thus, the inverse current may well be limited to prevent this considerable delay of the ignition time ($t$), but it the inverse current is limited, a inversely leaking current is flown into the transistor circuit TrC, which results in deterioration of effect in heat generation prevention in the transistor circuit TrC, thus unabling to attain the desired end.

A circuit for preventing heat generation in the transistor circuit and premature ignition (hereinafter referred to as a prevention circuit), as shown in FIG. 12, functions not to completely eliminate an inversely leaking current in the transistor circuit TrC but to flow the inversely leaking current to such extent as to have a heating value allowable in practical use, and to dispersedly flow it into the transistor circuit TrC in such a manner that a value of the inverse current including the inversely leaking current is made enough to be able to prevent premature ignition. The basic circuit, to which the circuit shown in FIG. 12 is embodied, is preferably in the form of one using a Darlington circuit as a transistor circuit TrC.

Referring now to FIG. 12, a series circuit consisting of an inverse current blocking diode $D_5$ and a current limiting resistor $R_6$ is connected between the emitter E and the base B in the transistor circuit TrC using the Darlington circuit in the mode in which only a current from emitter E to base B is flown.

A value of resistor $R_6$ is determined according to a value of a stabilized resistor ($r$) in the transistor circuit using the Darlington circuit, magnitude of which is smaller than the resistor ($r$) but a value to such extent that an inverse current does not flow through the prevention circuit without any restriction. That is, since the resistor ($r$) is determined according to the construction of the Darlington circuit or the rated value of transistors $Tr_1$ and $Tr_2$, the upper limit of value of resistor $R_6$ which is sufficiently smaller than said resistor ($r$) is naturally limited, and the lower limit thereof is determined in such a manner that building-up of the proper current is not apt to be delayed by the inverse current flown into the primary winding 1.

With the prevention circuit shown in FIG. 12 constructed as described above, an inverse current $I_1$ branches and flows into current $I_3$ flowing in line $l_1$ and current $I_2$ flowing in line 2. Since resistor R is set in value smaller than resistor ($r$), current $I_2$ is much greater in value than current $I_3$. Current $I_2$ branched into line $l_2$ or the prevention circuit is flown as current $I_4$ from base to collector of the transistor $Tr_2$ in the Darlington circuit. Currents $I_2$ and $I_4$ are almost same in value, but current $I_4$ is slightly smaller than current $I_2$ since a part of current is branched into the trigger circuit TG when current $I_2$ is flown into the transistor $Tr_2$. On the other hand, current $I_3$ is branched into lines $l_3$ and $l_4$, and current $I_6$ branched into $l_3$ turns to be an inversely leaking current from transistor $Tr_1$ and is much smaller in value than current $I_5$ branched into line $l_4$ having a resistor ($r$) since an inverse resistance of the transistor $Tr_1$ is extremely great. At the connection between the base of transistor $Tr_1$ and the emitter of the transistor $Tr_2$, current $I_5$ flown into line $l_4$ is branched into current $I_7$, which is inversely leaking current from the transistor $Tr_2$ flowing from emitter to collector in the transistor $Tr_2$, and current $I_8$ flown from base to collector in the transistor $Tr_1$. Current $I_8$ is much greater in value than current $I_7$ since resistance between base and collector in the transistor $Tr_1$ is much smaller in value than resistance between emitter and collector in the transistor or an inverse resistance in the transistor. That is, the prevention circuit is so constructed that an inverse current is flown into the Darlington circuit. However, since inversely leaking currents or currents $I_6$ and $I_7$ which cause heat generation to be occurred in the transistors $Tr_1$ and $Tr_2$ are extremely small in value, the heat generation in the transistors $Tr_1$ and $Tr_2$ (in actual use, only up to 20°C or so) is not at all hindered from actual using.

Further, an inverse current $I_1$ in the amount to such extent that prespark is not produced and restricted by resistor $R_6$ the resistor ($r$) is flown into the primary winding 1, and the inverse current $I_1$ is much smaller in absolute value, as shown in FIG. 13(*a*), than that of the primary short-circuit current I, so that there is little delay in building up of the primary short-circuit current I as compared with a prespark prevention method in which as shown in FIG. 13(*b*) a bypass is provided in the transistor circuit TrC to flow all the inverse current $I_1$, thereby achieving the ignition time (*t*) with good timing.

Instead of accomplishing the prevention of heat generation in transistors or prevention of occurrance of prespark by not completely flowing the inverse current into the Darlington circuit, the circuit of the present invention provides such that an inverse current flows through the Darlington circuit, but an inversely leaking current portion which causes heat generation in the transistor out of the inverse current flown in the Darlington circuit is controlled to a very small value so as to hold heating value generated in the transistor within the range not at all hindered from actual using, thereby preventing prespark, and preventing building up of the proper current from being delayed, whereby the internal combustion engine may be placed in good operating condition.

On the other hand, the circuit of the invention is to be mounted on the internal combustion engine so that it is desired to adjust the ignition time (*t*) in accordance with operating speed of the internal combustion engine. However, some of internal combustion engines according to their type are desired to automatically adjust the ignition time (*t*) in order to obtain a maximum output when reached a predetermined rotating speed, or in order to rapidly reduce rotating speed so as to prevent overrun when in excess of a predetermined rotating speed.

FIGS. 14–16 illustrate arrangement of automatic adjustment to the ignition time (*t*) with a certain rotating speed predetermined.

FIG. 14 is a circuit for automatically placing ignition timing in angle of lead disposed in the trigger circuit TG, in which trigger time of $SCR_1$ is placed in angle of lead to automatically place ignition time in angle of lead. A series circuit consisting of a resistor $R_9$ and $SCR_2$ is connected in parallel with resistor $R_2$ in a bias circuit of the trigger circuit TG shown in FIG. 3; a dividing circuit comprising a series connection of resistor $R_{10}$ and resistor $R_{11}$ is connected between the terminals of the primary winding 1; and gate of $SCR_2$ is connected to a divided point in the dividing circuit.

As is apparent from the above-described construction, the series circuit consisting of a resistor $R_9$ and $SCR_2$ is connected in parallel with the resistor $R_2$ so that by triggerring $SCR_2$, resistance between contacts (*a*) and (*b*) may be reduced by value according to the value of the resistor $R_9$ less than when $SCR_2$ is not triggerred. Further, a dividing circuit consisting of resistors $R_{10}$ and $R_{11}$ is set in value so that $SCR_2$ is triggerred when primary short-circuit current I reaches a predetermined value, said current I increasing its value in proportion to the rotational speed of the internal combustion engine as the rotational speed elevated to a predetermined value. Accordingly, since the rotational speed of the internal combustion engine which triggers $SCR_2$ is determined by values of resistors $R_{10}$ and $R_{11}$ and the ratio therebetween, it is advantageous that trigger time of $SCR_2$ may be freely set with the resistor $R_{10}$ served as a variable resistor.

In FIG. 14, a bias resistance portion, in which a parallel circuit consisting of a resistor $R_8$ as a bias resistance of $SCR_1$ and a thermistor Th is connected to resistor $R_7$ in series, is provided for temperature compensation to prevent variation in trigger time of $SCR_1$ caused by temperature variation. Connection of the thermistor to the gate of SCR for the purpose of temperature compensation with respect to operation of SCR is well known, so that details thereof is herein omitted.

With the circuit for automatically placing ignition timing in angle of lead constructed as described above, when resistor $R_{10}$ and resistor $R_{11}$ are preset so that $SCR_2$ is triggerred as primary short-circuit current I reaches a predetermined value, $SCR_2$ is triggerred when the rotational speed of the internal combustion engine rises and reaches a predetermined rotational speed, and this triggerring of $SCR_2$ brings connection of resistor $R_9$ in parallel with resistor $R_2$, and a combined resistance value of resistors $R_9$ and $R_2$ in parallel is appeared between contacts (*w*) and (*x*) in which a resistance value of only resistor $R_2$ has previously been appeared, thus reducing its resistance value. That is, the resistance value between contacts (*w*) and (*x*) relative to the resistance value of the bias resistance portion is reduced.

The reduction in the ratio between the bias resistance portion and the resistance value of the dividing resistance portion causes the trigger time of $SCR_1$ to be placed in angle of lead by the amount thus reduced.

The degree of the angle of lead may be freely set by the value of resistor $R_9$ to resistor $R_2$, and also starting time of action for the angle of lead caused by triggerring $SCR_2$, or the rotational speed of the internal combustion engine may be freely set by individual values of resistors $R_{10}$ and $R_{11}$ and the relative ratio.

In accordance with the circuit of the present invention as described above, when resistors $R_{10}$ and $R_{11}$ are preset in value so that $SCR_2$ is triggerred with the rotational speed (*n*) which requires the strongest horse power of the internal combustion engine, ignition time (*t*) of the internal combustion engine at the time when the rotational speed of the internal combustion engine reaches speed (*n*) is automatically placed in angle of lead by the amount according to the ratio of the resistance value of the resistor $R_2$ with respect to the resistance value of the parallel circuit consisting of resistors $R_2$ and $R_9$, thereby increasing the horse power of the internal combustion engine.

Thus, the circuit for automatically placing ignition timing in angle of lead shown in FIG. 14 provides a number of advantages such that the present circuit may be disposed in an ignition circuit for the internal combustion engine which attempts to obtain a maximum output at a suitable rotational speed to obtain an output in a desired form from the internal combustion engine, and the present circuit can operate positively as compared with the conventional mechanism for mechanically placing ignition timing in angle of lead and is simple in construction and may be set in a suitable position, and further there is no fear at all extensively increasing the volume of the ignition circuit.

A circuit shown in FIG. 15 is based on the same operating principle as that of the circuit for automatically placing ignition timing in angle of lead, in which the resistance value of the bias circuit in $SCR_1$ for the trigger circuit TG is varied to vary trigger time of $SCR_1$ thus varying the ignition time (*t*), whereby the ignition time (*t*) may be automatically placed in angle of lag as desired. A series circuit consisting of a resistor $R_9$ and $SCR_2$ is connected in parallel with the bias resistance portion in the trigger circuit TG shown in FIG. 3 (In the embodiment shown in FIG. 15, resistor $R_7$ is connected in series with the parallel circuit consisting of a resistor $R_8$ and a thermistor Th for temperature compensation of $SCR_1$, similar to the embodiment shown in FIG. 14); a dividing circuit comprising a series connection of resistors $R_{10}$ and $R_{11}$ is connected between terminals of the primary winding 1; and gate of $SCR_2$ is connected to a divided point in the dividing circuit.

As is apparent from the above-described construction, the series circuit consisting of a resistor $R_9$ and $SCR_2$ is connected in parallel with the bias resistance portion so that by triggerring $SCR_2$, resistance between contacts ($y$) and ($z$) may be reduced according to the resistance value of the resistor $R_9$ less than when $SCR_2$ is not triggerred. Further, a dividing circuit consisting of resistors $R_{10}$ and $R_{11}$ has its resistors $R_{10}$ and $R_{11}$ set to their value so that $SCR_2$ is triggerred when primary short-circuit current I reaches a predetermined value, said current I increasing its value in proportion to the rotational speed of the internal combustion engine as the rotational speed elevated to a determined value. Accordingly, it is advantageous to provide with a resistor $R_{10}$ in the form of a variable resistor so that the rotational speed of the internal combustion engine which triggers $SCR_2$ may be freely set.

With the circuit for automatically placing ignition timing in angle of lag constructed as described above, when the ratio between resistors $R_{10}$ and $R_{11}$ is so preset that $SCR_2$ is triggerred as primary short-circuit current I reaches a predetermined values, $SCR_2$ is triggerred when the rotational speed of the internal combustion engine rises and exceeds the set rotational speed, and this triggerring of $SCR_2$ brings connection of resistor $R_9$ in parallel with the bias resistance portion, and a combined resistance value of the bias resistance portion and the resistor $R_9$ in parallel is appeared between contacts ($y$) and ($z$) in which a resistance value of only bias resistance portion has previously been appeared, thus reducing its resistance value. That is, the bias resistance value of $SCR_1$ is reduced.

This reduction of the bias resistance value with respect to the resistance value of the dividing resistor $R_2$ requires a current greater in value which is necessary for triggerring $SCR_1$, thereby placing the trigger time of $SCR_1$ or ignition time ($t$) in angle of lag.

The degree of the angle of lag may be freely set by the resistance value of resistor $R_9$ to the bias resistance portion, and also starting time of action for the angle of lag caused by triggerring $SCR_2$, or the rotational speed of the internal combustion engine may be freely set by individual values of resistors $R_{10}$ and $R_{11}$ and the relative ratio.

In accordance with the circuit for automatically placing ignition timing in angle of lag as shown in FIG. 15, when resistors $R_2$ and $R_3$ are preset in value so that $SCR_2$ is triggerred with the rotational speed ($n$) lower to some extent than the rotational speed which causes the internal combustion engine to be overrun, ignition time of the internal combustion engine is automatically placed in angle of lag by the amount corresponding to the resistor $R_1$ when the rotational speed of the internal combustion engine reaches a speed ($n$), thereby descreasing the rotational speed of the internal combustion engine, whereby the overrun of the internal combustion engine may be prevented.

A circuit for automatically placing ignition timing in angle of lag shown in FIG. 16 is different in operating principle of its operation relative to the angle of lag from the circuit for automatically placing ignition timing in angle of lag shown in FIG. 15, in which by utilizing delay of building up of primary short-circuit current I caused by flowing an inverse current $I_1$ as previously described with respect to the prevention circuit shown in FIG. 12, the ignition time ($t$) is automatically placed in angle of lag as desired when the internal combustion engine reaches a desired rotational speed, whereby the overrun of the internal combustion engine may be prevented. The ignition circuit disposed in the circuit shown in FIG. 16 is not limited to the ignition circuit shown in FIG. 3 such as circuits shown in FIGS. 14 and 15. Referring now to FIG. 16, which illustrates a circuit for angle of lag, a dividing circuit comprising a series connection of resistors $R_{12}$ and $R_{13}$ and a parallel circuit comprising $SCR_3$ are connected between terminals of primary winding 1 in parallel with the transistor circuit TrC, and gate of $SCR_3$ is connected to a divided point in the dividing circuit.

As is apparent from the above-described circuit, $SCR_3$ in the circuit for angle of lag shown in FIG. 16 may be set so that $SCR_3$ is triggered by the ratio of resistance value between the resistors $R_{12}$ and $R_{13}$ when an inverse current reaches a predetermined value or the rotational speed of the internal combustion engine reaches a predetermined value. Therefore, when individual values of resistors $R_{12}$ and $R_{13}$ and the relative ratio are properly preset so as to trigger $SCR_3$ at a rotational speed ($n$) prior to occurrance of overrun of the internal combustion engine, $SCR_3$ is triggered when the rotational speed of the internal combustion engine rises and reaches the rotational speed ($n$) immediately before the occurrance of overrun, and an adverse current is flown into the primary winding 1 through $SCR_3$. Thus, building-up of primary short-circuit I in a successive current cycle is delayed from the condition shown in ($a$) in FIG. 17 to the condition shown in ($b$) in FIG. 17, and then by reasons of this delay, time reaching the value of primary short-circuit current I which can trigger $SCR_1$ is delayed from time $t_1$ to time $t_2$, thereby achieving the angle of lag for the ignition timing. The ignition timing is thus placed in angle of lag to reduce the rotational speed of the internal combustion engine which has been in the mode of elevation, thus preventing the overrun of the internal combustion engine.

Thus, the circuits for automatically placing ignition timing in angle of lag shown in FIGS. 15 and 16 can freely set the rotational speed of the internal combustion engine which performs an operation for angle of lag merely by proper combination of resistors by which a dividing circuit is formed, so that the circuit may be incorporated into an ignition circuit to be disposed in the initial combustion engine driven in the mode of use in which loading condition is rapidly turned to unloading condition, e.g. internal combustion engine used for saw, etc. which cuts a big tree, so as to securely prevent overrun of the internal combustion engine.

FIGS. 18A and 18B illustrate embodiments of a method for preventing premature ignition in accordance with an operating principle, which is different from the premature ignition prevention circuit shown in FIG. 12. The occurrance of the premature ignition is caused by the magnetic induction action from the permanent magnet Mg acted on the secondary winding 2 wound on the same core 6 as that of the primary winding 1. According to the premature ignition prevention methods described in the prevention circuit shown in FIG. 12 and the prevention circuit shown in FIG. 12, the magnetic action on the secondary winding 2 by magnetic flux in counter direction from the permanent magnet Mg, which is the cause of said premature ignition, is offset by flowing an inverse current into the primary winding 1. Thus, in the method for preventing premature ignition by flowing an inverse current I into the primary winding 1, as in the prevention circuit shown in FIG. 12, the phenomenon essentially arisen by the magnetic action of the inverse flux from the permanent magnet Mg is utilized with the magnetic action of the inverese flux to the secondary winding 2 from the permanent magnet Mg which is considered to be the basical cause of the premature ignition left as it is, and therefore the heat generation in the transistor circuit TrC can not be prevented satisfactorily or the ignition time (*t*) is delayed, etc., which are unavoidable problems inconveniently involved in the ignition circuit for the internal combustion engine.

A method for preventing premature ignition shown in FIGS. 18A and 18B, which illustrate two embodiments, eliminates premature ignition and overcomes various problems encountered in the premature ignition prevention method by flowing an inverse current I into the primary winding, by completely removing the magnetic action from the permanent magnet Mg on the secondary winding 2, which is the basical cause of the premature ignition. In accordance with this method for preventing premature ignition, primary winding 1 of the ignition coil T is divided into a generating coil (1*a*) and an induction coil (1*b*) in such a manner that the generating coil (1*a*) is connected in series with the induction coil (1*b*), said generating coil (1*a*) being arranged in position opposite the permanent magnet Mg, while said induction coil (1*b*) being wound on the same core as that of the secondary winding 2 opposite the secondary winding 2, and the ignition coil T portion consisting of the induction coil (1*b*) and the secondary winding 2 being magnetically cut-off from the permanent magnet Mg so that magnetic action of magnetic flux from the permanent magnet Mg may not at all be acted on the secondary winding 2.

Referring now to FIG. 18 illustrating details of the prevention method as described above, the method according to the present invention may be grouped into two modes, one of which is shown in FIG. 18A, and the other of which is shown in FIG. 18B, in consideration of a connection mode of the ignition coil T and the ignition circuit.

In the embodiment shown in FIG. 18A, when primary short-circuit current I flowing into an induction coil (1*b*) which is a part of primary winding 1 would opposite secondary winding 2, or an induction coil (1*b*) which is a part of primary winding 1 wound on the same core as that of secondary winding 2, is rapidly cutoff, a high voltage is inducted in secondary winding 2 to produce spark discharge in plug P. In the embodiment shown in FIG. 18B, when primary short-circuit current I is flowing into the induction coil (1*b*), spark discharge is produced.

In either embodiment in FIG. 18A or embodiment in FIG. 18B, the generating coil (1*a*) and the induction coil (1*b*) are divided and are magnetically cut-off completely, so that the secondary winding 2 never receives magnetic action other than the induction coil (1*b*).

Therefore, in the embodiment shown in FIG. 18A, the ignition circuit is in cut-off condition even if an inverse voltage is produced in the generating coil (1*a*) so that current is not flowing into the induction coil (1*b*), thereby not occurring magnetic induction in the secondary winding 2 which is the cause of the premature ignition. Similarly, since the magnetic force of the permanent magnet is not at all acting on the secondary winding, voltage is never induced in the secondary winding 2 at the time when an inverse voltage is produced in the generating coil (1*a*).

Further, in the embodiment shown in FIG. 18B, when an inverse voltage is produced in the generating coil (1*a*), an inverse current is flowing into the induction coil (1*b*), which forms the same mode as that of the above-described method for preventing premature ignition by flow of an inverse current $I_1$. From this, this method is also considered that the phenomenon with respect to angle of lag for ignition timing may similarly occur, but according to the method by flow of an inverse current $I_1$, primary short-circuit current is flowing into the primary winding (corresponding to the induction coil (1*b*) from the beginning of buildingup and ignition is taken place by rapidly cutting off said primary short-circuit current I, while according to embodiment shows in FIG. 2, primary short-circuit current I previously not flowing is rapidly flowing into the induction coil (1*b*) at the time of ignition, and therefore there is no fear at all of electromagnetically occurring an angle of lag for ignition timing.

Thus, the present invention provides an excellent method for preventing premature ignition in an ignition device for the internal combustion engine incorporating a basic circuit shown in FIG. 1, having advantages such that there is no inconveniences caused by action of an inverse magnetic flux on the secondary winding 2 because the magnetic action from the permanent signal Mg on the secondary winding 2 is completely cut-off, and there is not required to add a special circuit in order to prevent ignition circuit and premature ignition, so that the construction may be simplified.

As is apparent from the foregoing, the ignition circuit in accordance with the present invention may provide extremely good conduct and cut-off control of primary short-circuit current I and ignition control despite the employment of transistor circuit TrC, which has hitherto been considered unsuitable for this type of ignition circuit, and may employ an extremely simple circuit construction so that it may be manufactured and mounted in smallsized and in one-piece, thus simple in handling and an optimum ignition operation may readily attained according to operational requirements of the internal combustion engine to which this circuit is disposed. Further, the premature ignition prevention method in accordance with the present invention provides an extremely good premature ignition prevention method to be used for an ignition circuit for the internal combustion engine and an ignition circuit.

What is claimed is:

1. An ignition circuit for an internal combustion engine comprising:
   a. a transformer having a primary winding and a secondary winding;
   b. an electronic switching circuit, including a gate terminal, connected across said primary winding; and
   c. a trigger circuit connected across said primary winding for controlling the conductivity of said electrical switching circuit to thereby periodically induce a short-circuit current in said secondary winding, said trigger circuit including a first silicon controlled rectifier connected in series with a first bias resistor across said primary winding, said gate terminal being connected at a point between said first bias resistor and said silicon controlled rectifier.

2. An ignition circuit, as set forth in claim 1, wherein said trigger circuit further comprises:

a. a series circuit including a resistor and an inverse current blocking diode connected between one end

3. An ignition circuit, as set forth in claim 1, wherein said trigger circuit further comprises a circuit for automatically setting the angle of lead on the ignition timing, including:

a. a series circuit including a second silicon controlled rectifier and a resistor, said series circuit being connected across a first dividing resistor and being connected at one end of said primary winding and at the other end to the gate of said first silicon controlled rectifier, and b. a second dividing resistor and a second bias resistor connected across the terminals of said primary winding, the gate of said second silicon controlled rectifier being connected to a point between said second dividing resistor and said second base resistor.

4. An ignition circuit, as set forth in claim 1, wherein said trigger circuit further comprises a circuit for automatically setting the angle of lead on the ignition timing, including:

a. a second silicon controlled rectifier connected in series with a resistor between the gate of said first silicon controlled rectifier and one end of said primary winding, and b. a dividing resistor and a second bias resistor connected across the terminals of said primary winding, the gate of said second silicon controlled rectifier connected to a point between said second dividing resistor and said second bias resistor.

5. An ignition circuit for an internal combustion comprising:

a transformer having a primary winding and a secondary winding;

an electronic switching circuit, including a gate terminal, connected across said primary winding; and a trigger circuit connected across said primary winding for controlling the conductivity of said electronic switching circuit to thereby periodically induce a short-circuit current in said secondary winding, said trigger circuit comprising:

a. a first silicon controlled rectifier connected in series with a first bias resistor across said primary winding, said gate terminal being connected at a point between said first bias resistor and said silicon connected rectifier;

b. a bias circuit connected across said primary winding including a dividing resistor connected in series with a second bias resistor; and c. an inverse current blocking diode connected between the gate of said silicon controlled rectifier and a point between said dividing resistor and said second bias resistor.

* * * * *

UNITED STATES PATENT AND TRADEMARK OFFICE

CERTIFICATE OF CORRECTION

PATENT NO. : 3,958,546

DATED : May 25, 1976

INVENTOR(S) : YOSHINORI OHKI; YOSHIO KATO

It is certified that error appears in the above-identified patent and that said Letters Patent are hereby corrected as shown below:

Claim 2, following line 4, add:

--of said primary winding and the gate of said silicon controlled rectified, and (b) a gate resistor connected across a condenser and between the gate and the cathode of said silicon controlled rectifier to adjust the angle of lead between the gate and the cathode of said silicon controlled rectifier.--

Add claim 6:

--6. An ignition circuit, as set forth in claim 1, wherein said trigger circuit further comprises a trigger coil connected across a second bias resistor and connected at one end to the cathode of said silicon controlled rectifier and at the other end to the gate of said silicon controlled rectifier.--

Signed and Sealed this

Fourteenth Day of June 1977

[SEAL]

*Attest:*

RUTH C. MASON
*Attesting Officer*

C. MARSHALL DANN
*Commissioner of Patents and Trademarks*